US008740590B2

(12) United States Patent
Unruh

(10) Patent No.: US 8,740,590 B2
(45) Date of Patent: Jun. 3, 2014

(54) HYPERBOLIC HORN FOR PULSATION FILTER DEVICE USED WITH GAS COMPRESSOR

(75) Inventor: James F. Unruh, Helotes, TX (US)

(73) Assignee: Southern Gas Association Gas Machinery Research Council, Dallas, TX (US)

( * ) Notice: Subject to any disclaimer, the term of this patent is extended or adjusted under 35 U.S.C. 154(b) by 793 days.

(21) Appl. No.: 11/958,186

(22) Filed: Dec. 17, 2007

(65) Prior Publication Data

US 2009/0155108 A1 Jun. 18, 2009

(51) Int. Cl.

| | |
|---|---|
| ***F04B 11/00*** | (2006.01) |
| ***F04D 29/66*** | (2006.01) |
| ***F01N 1/00*** | (2006.01) |

(52) U.S. Cl.

CPC ..... *F04D 29/668* (2013.01); *F04B 11/0025* (2013.01); *F01N 1/003* (2013.01)

USPC ..... 417/540

(58) Field of Classification Search

CPC ... F04D 29/663; F04D 29/665; F04D 29/667; F04D 29/668; F04B 11/0016; F04B 11/0025; F04B 11/0091; F16L 55/052; F16L 55/02754; F16L 55/02736; F16L 55/02727; F16L 55/02709; F01N 1/003

USPC ..... 417/540, 542, 312; 181/229, 249

See application file for complete search history.

(56) References Cited

U.S. PATENT DOCUMENTS

| | | | | |
|---|---|---|---|---|
| 2,570,241 | A * | 10/1951 | Hutchinson | 417/540 |
| 2,936,041 | A | 5/1960 | Sharp et al. | |
| 5,005,353 | A | 4/1991 | Acton | |
| 5,040,495 | A * | 8/1991 | Harada et al. | 123/184.57 |
| 5,354,185 | A | 10/1994 | Moringo | |
| 5,760,349 | A * | 6/1998 | Borchers et al. | 181/286 |
| 5,957,664 | A * | 9/1999 | Stolz et al. | 417/53 |
| 2003/0136119 | A1 | 7/2003 | Marks et al. | |
| 2004/0234387 | A1 | 11/2004 | Marshall et al. | |
| 2006/0275158 | A1 | 12/2006 | Nagao et al. | |
| 2007/0154325 | A1 | 7/2007 | Grant | |
| 2007/0272178 | A1 | 11/2007 | Brun | |

* cited by examiner

*Primary Examiner* — Bryan Lettman

(74) *Attorney, Agent, or Firm* — Booth Albanesi Schroeder, LLC

(57) ABSTRACT

A method and system for reducing pulsation in a gas compressor system. A side branch absorber, which may be installed on the lateral piping of either the suction or discharge side of the cylinders, has a hyperbolic horn at the input end. The hyperbolic horn in series with an inlet reducer substantially increases the mass reactance of the resonator and substantially reduces the resonator frequency or the required cavity volume for a target resonator frequency. The horn is hyperbolic in the sense that it has a large diameter at the first end and tapers to a smaller diameter near the second end.

3 Claims, 5 Drawing Sheets

HYPERBOLIC HORN FOR PULSATION FILTER DEVICE USED WITH GAS COMPRESSOR

TECHNICAL FIELD OF THE INVENTION

This invention relates to reciprocating compressors for transporting natural gas, and more particularly to an improved method for controlling pulsation associated with such compressors.

BACKGROUND OF THE INVENTION

Most natural gas consumed in the United States is not produced in the areas where it is most needed. To transport gas from increasingly remote production sites to consumers, pipeline companies operate and maintain hundreds of thousands of miles of natural gas transmission lines. This gas is then sold to local distribution companies, who deliver gas to consumers using a network of more than a million miles of local distribution lines. This vast underground transmission and distribution system is capable of moving billions of cubic feet of gas each day. To provide force to move the gas, operators install large compressors at transport stations along the pipelines.

Reciprocating gas compressors are a type of compressor that compresses gas by using a piston in a cylinder and a back-and-forth motion. A suction valve in the cylinder receives input gas, which is compressed, and discharged through a discharge valve. Reciprocating compressors inherently generate transient pulsating flows and various devices and control methods have been developed to control these pulsations. An ideal pulsation control design reduces system pulsations to acceptable levels without compromising compressor performance.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

Figure 1:
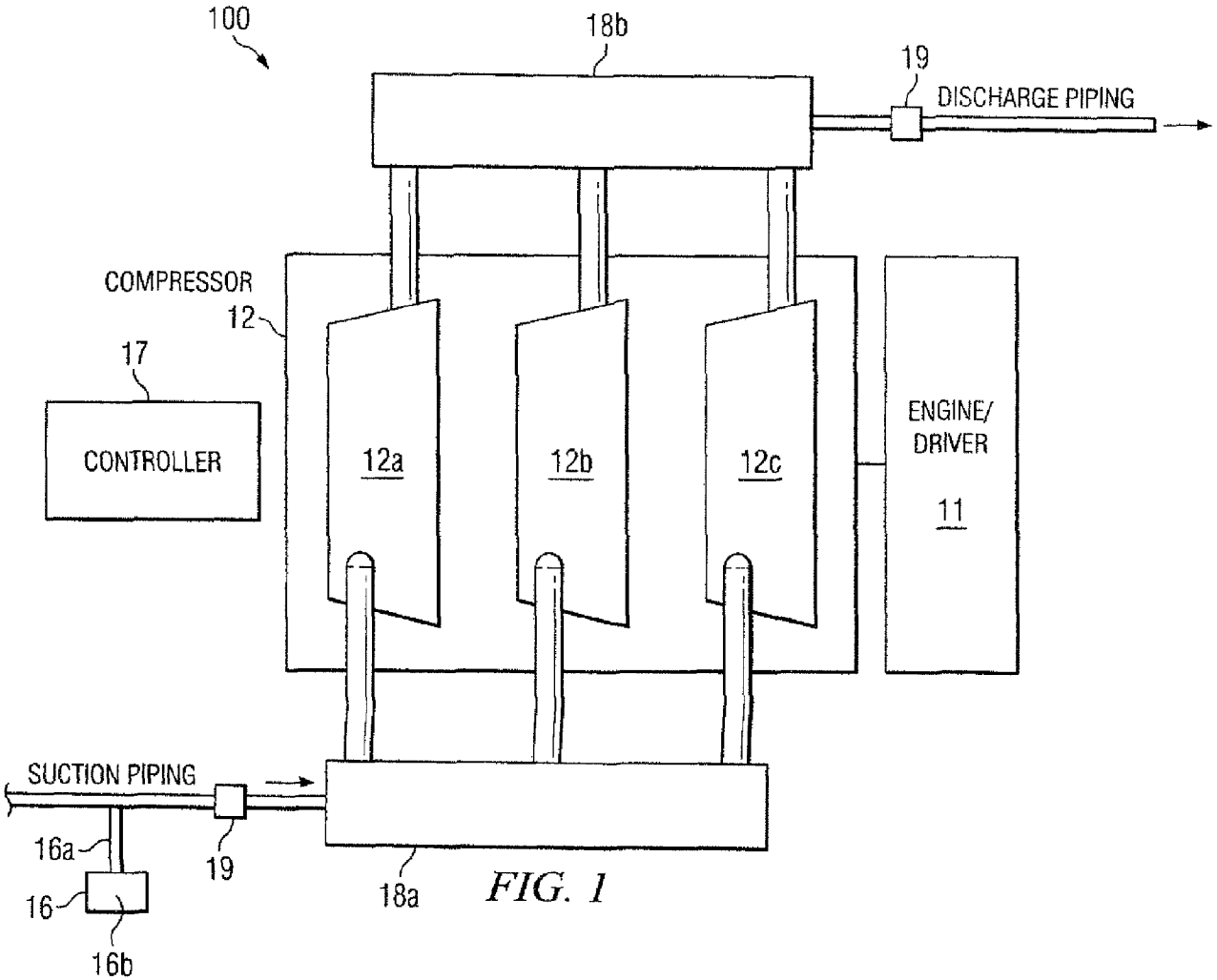
FIG. 1 illustrates a typical reciprocating compressor system.

FIG. 1 is a block diagram of the basic elements of a typical ("generic") reciprocating gas compressor system 100. Compressor system 100 has a driver 11, compressor 12, side branch absorber 16, suction filter bottle 18*a*, discharge filter bottle 18*b*, suction and discharge piping connections, and a controller 17.

In the example of FIG. 1, compressor 12 has three compressor cylinders 12*a*-12*c*. In practice, compressor 12 may each have fewer or more cylinders. Further, it may have either an integral or separate engine or motor driver 11.

The following description is written in terms of the "generic" compressor system 100. However, the same concepts are applicable to other compressor configurations.

A typical application of compressor system 100 is in the gas transmission industry. It operates between two gas transmission lines. A first line, at a first pressure, is referred to as the suction line. A second line, at a second pressure, is referred to as the discharge line. Typically, the suction pressure and discharge pressure are measured in psi (pounds per square inch). The suction and discharge lines are also referred to in the industry as the "lateral piping".

Side branch absorber (SBA) 16 reduces residual low frequency pulsations by altering the amplitude of the responses in the lateral piping. SBA 16 may be installed on piping 19 on either the discharge or suction side of the compressor. SBA 16 comprises a choke tube 16a and surge volume 16b. Choke tube 16a is a span of conduit connecting the lateral piping to a surge volume 16b.

Compressor system 100 may also have filter bottles 18*a* and 18*b*. Filter bottles 18*a* and 18*b* are used to reduce compressor system pulsations. These filter bottles are placed between the compressor and the lateral piping, on the suction or discharge side or on both sides.

The effectiveness of SBA 16 and filter bottles 18*a* and 18*b* is dependent on their size and configuration and the pulsation frequencies that are to be controlled due to the speed of the compressor. Controller 17 is used for control of parameters affecting compressor load and capacity.

Figure 2:
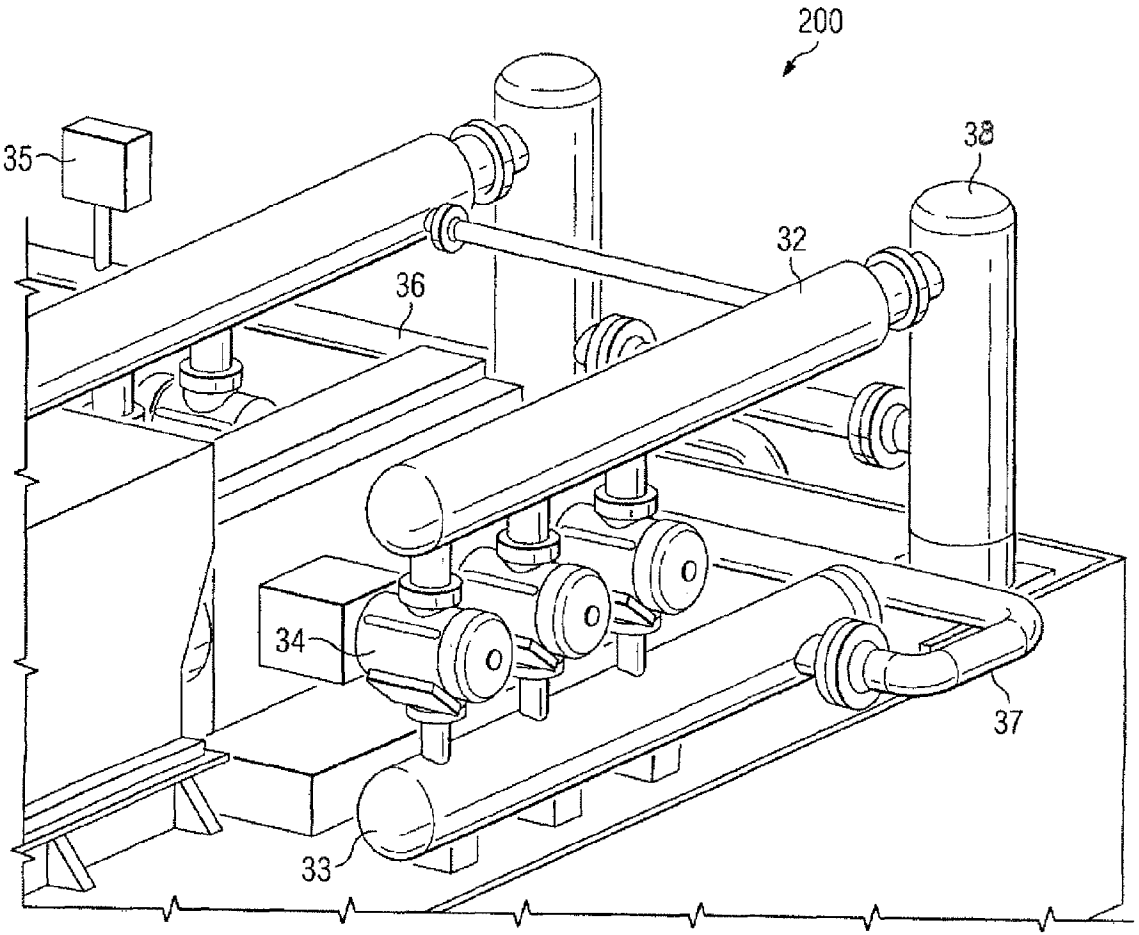
FIG. 2 illustrates a side branch absorber, as well as suction side and discharge side manifold pulsation filter bottles, used with a compressor system.

FIG. 2 is a partial perspective view of a reciprocating gas compressor system 200. Only one side of the compressor system, with three cylinders 34, is fully illustrated; implicit in FIG. 2 are three additional cylinders on the other side. Each set of three cylinders 31 is connected to both a suction-side pulsation filter bottle 32 and a discharge-side pulsation filter bottle 33. The suction piping 36 and discharge piping 37 are also shown, as well as a vertical scrubber/filter bottle 38 between the suction piping 36 and suction filter bottle 32. An SBA 35 is installed on the suction piping.

Pulsation filter bottles 32 and 33 are "internal choke tube" filter bottles. The filter bottles have two or more internal chamber volumes, separated by baffles, and pair of chamber volumes having a choke tube for carrying gas from one chamber to the other. In other embodiments, filter bottles may have external choke tubes, also implemented as volume-choke-volume devices. Both types of filter bottles function as low-pass acoustic filters, and attenuate pulsations on the basis of a predetermined response.

Figure 3:
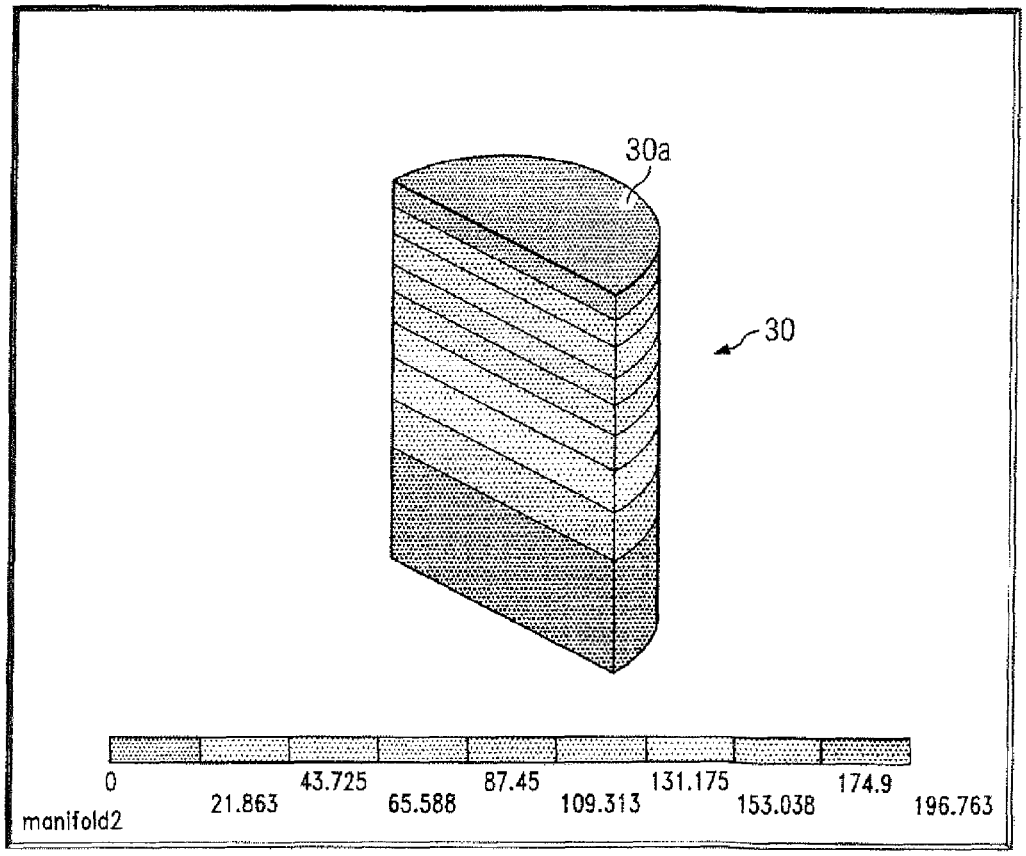
FIG. 3 illustrates a side branch absorber, implemented with a simple volume without an inlet reducer.

FIG. 3 is a section view of an SBA 30 comprising only a simple cylindrical volume 32. A first end 30a is open to the compressor piping such that gas flowing through the piping flows past first end 30a.

The low frequency sound reduction required for gas compressor piping requires high mass reactance to reduce suppression equipment cavity volume. Low mass reactance requires ¼ wave length side branch to generate out-of-phase wave cancellation. The side branch length is equivalent to a mechanical spring; the longer the side branch the lower the spring constant. In the example of FIG. 3, SBA 30 has a 22 inch diameter and 36 inch length, and has a resonance at 112 Hz.

Figure 4:
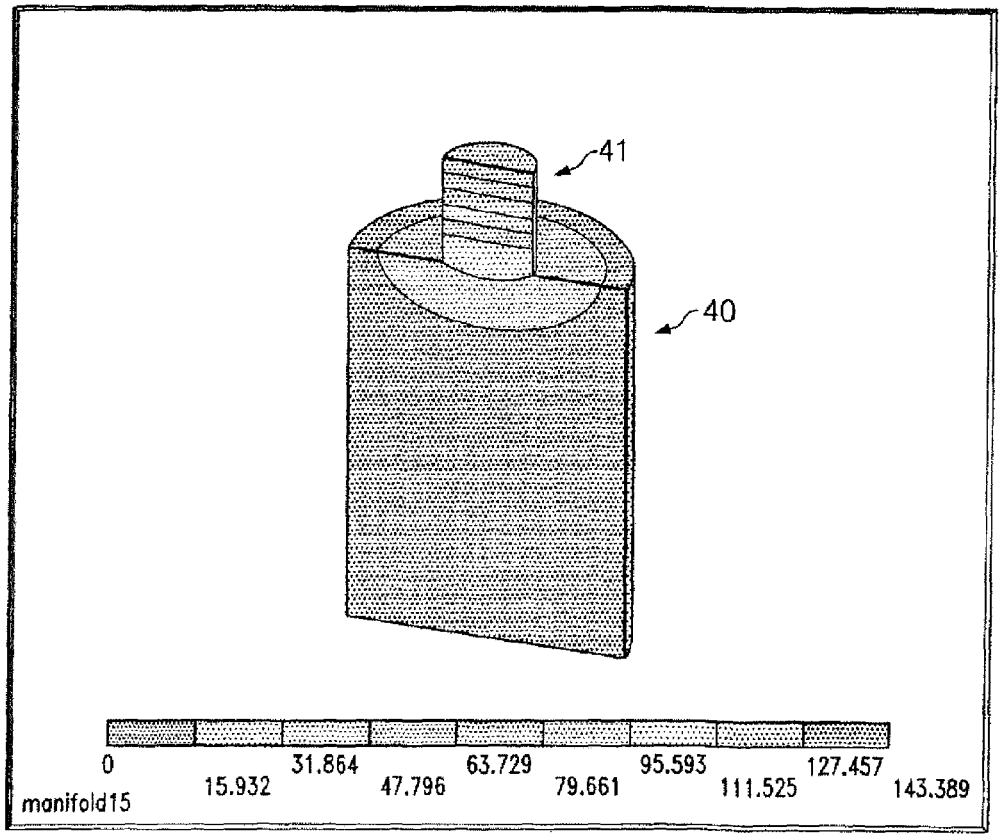
FIG. 4 illustrates the side branch absorber of FIG. 3 with an inlet reducer.

FIG. 4 illustrates an SBA 40 with an inlet reducer 41. Adding a reducer 41 (throat) to the SBA 40 adds mass reactance and produces a Helmholtz resonator, where the larger the branch volume the lower the spring constant. The larger the throat length/area ratio the higher the mass reactance. In the example of FIG. 4, a 7 inch diameter throat 41 of length 10 inches reduces the resonant frequency to 37.4 Hz.

Further reduction of the resonant frequency of the SBA of FIG. 4 would require either increasing the resonator volume or increasing the resonator mass:

$$freq \approx \sqrt{\frac{\text{Stiffness}(1/Volume)}{\text{Mass}}}$$

Decreasing the resonator stiffness by increasing the resonator volume increases the size of the SBA, which is not acceptable. More efficient means of increasing the resonator mass is needed to reduce the size of pulsation equipment in gas compressor piping installations.

Figure 5:
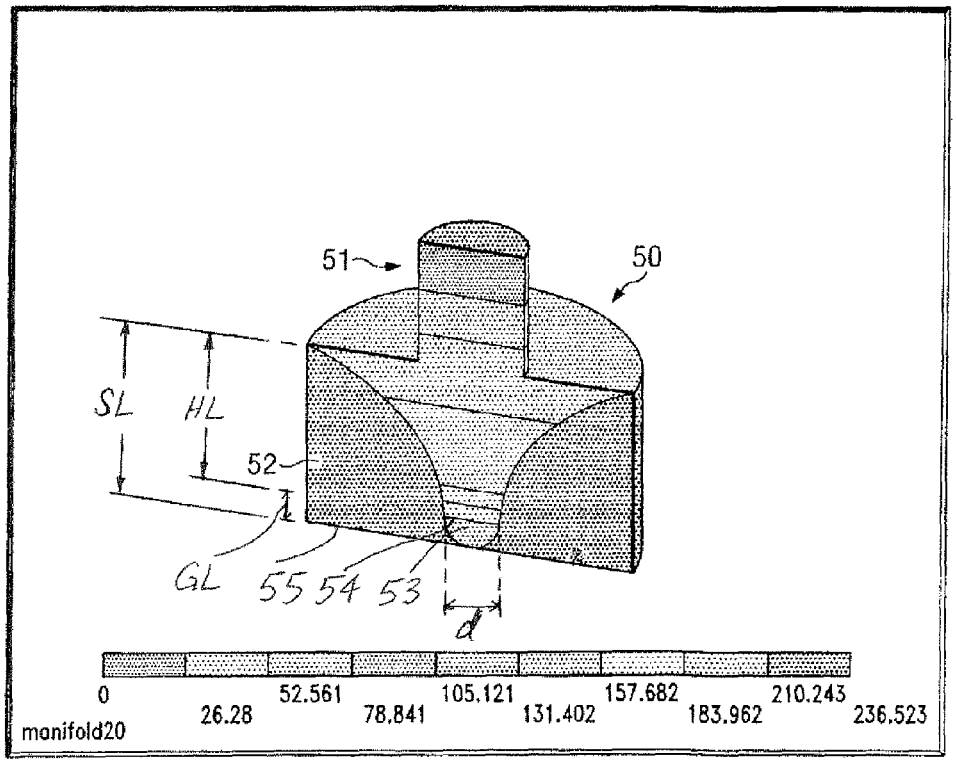
FIG. 5 illustrates a side branch absorber with an inlet reducer and hyperbolic horn.

FIG. 5 illustrates how inserting a hyperbolic horn 52 into the SBA 50, in series with the inlet reducer 51, can substantially increase the mass reactance of the resonator and substantially reduce the resonator frequency or substantially reduce the required cavity volume for a target resonator frequency. The horn 52 is "hyperbolic" in the sense that it has a large diameter at the first end and tapers to a smaller diameter near the second end. In the example of FIG. 5, the diameter of the horn 52 at the first end is the same as the volume diameter of the SBA.

In the example of FIG. 5, fitting SBA 50 with a horn of length, HL, 14 inches and throat diameter, d, of 3.5 inches reduced its length SL, from 36 inches to 15 inches to produce the same frequency response. Thus, where horn 52 is 14 inches long, there is a 1 inch gap 53. length GL, between the open end 54 of the horn and the bottom 55 of the SBA volume.

Application of a hyperbolic horn to increase mass reactance to reduce suppression device volume is applicable to other gas compressor pipe line pulsation suppression devices in addition to SBA's.

Figure 6:
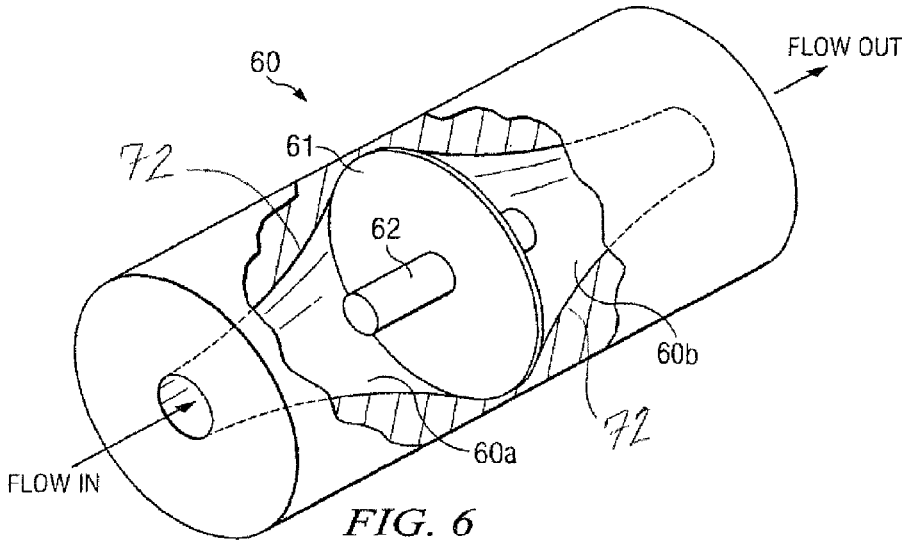
FIG. 6 illustrates a filter bottle with two opposing hyperbolic horns.

FIG. 6 illustrates how, for filter bottles, volume reduction can be achieved by connecting a pair of horn fitted volumes to a common choke tube. In the example of FIG. 6, filter bottle 60 has a first volume 60a separated from a second volume 60b by a baffle 61. An internal choke tube 62 through the baffle permits flow from one volume to the other. Each volume has a hyperbolic horn 72 similar to that described above in connection with FIG. 5.

A filter bottle may alternatively have an external rather than internal choke tube. In this configuration, the two volumes are physically separate but connected by a choke tube. A hyperbolic horn in each volume is structured similarly to those of FIG. 5.

Another application of a hyperbolic horn is with distributed SBA's, which are acoustic liners comprised of a resistive face sheet backed by a horn fitted resonator volume and distributed along the pipe line. The gas flow is confined to the transmission pipe and not routed through the acoustic liner, thereby greatly reducing the pressure drop experienced by conventional reactive volume-choke-volume resonators. This type of SBA's would look similar to the SBA of FIG. 5, but without a reducer inlet 51.

What is claimed is:

1. An apparatus comprising:

a gas compressor system, the gas compressor system having one or more cylinders fluidly connected to suction piping at an input side and discharge piping at an output side, gas flowing through interior passageways defined by the suction and discharge piping;

a side branch absorber connected to the suction or discharge piping for reducing gas pulsations associated with the gas compressor system;

the side branch absorber comprising a Helmholtz resonator and therefor having a volume housing defining an interior space filled with a fluid which acts as a spring, and having a relatively narrow inlet reducer filled with the fluid which acts as a mass attached to the spring;

the inlet reducer extending from the suction or discharge piping to the volume housing; and a hyperbolic horn internal to the volume housing, the horn having a large diameter at a first end and tapering to a smaller diameter near a second end, the horn first end attached to the inlet reducer, the horn increasing a mass reactance of the side branch absorber.

2. The apparatus of claim 1, further comprising a gap between the second end of the horn and the volume housing.

3. The apparatus of claim 1, wherein the positioning of the horn within the side branch absorber effectively reduces the required volume of the interior space for a selected side branch absorber.

* * * * *